United States Patent [19]

Silcott et al.

[11] Patent Number: 4,712,687

[45] Date of Patent: Dec. 15, 1987

[54] COLLAPSIBLE PALLET CONTAINER AND MULTI-WALL FIBREBOARD CONTAINER THEREFOR

[75] Inventors: Terry L. Silcott, Hicksville, Ohio; Dale T. French, South Lyon, Mich.

[73] Assignee: Weyerhaeuser Company, Tacoma, Wash.

[21] Appl. No.: 883,340

[22] Filed: Jul. 8, 1986

[51] Int. Cl.[4] ..... B65D 19/00

[52] U.S. Cl. ..... 206/600; 206/386; 229/41 R; 229/41 B; 108/56.1

[58] Field of Search ..... 206/386, 340, 600; 229/41 R, 41 B; 108/53.1, 53.3, 53.5, 56.1

[56] References Cited

U.S. PATENT DOCUMENTS

| | | | |
|---|---|---|---|
| 2,761,609 | 9/1956 | Arkin . | |
| 2,898,029 | 8/1959 | Sherman | 229/41 B |
| 2,985,553 | 9/1957 | Anderson . | |
| 3,036,752 | 5/1962 | Elliott . | |
| 3,123,276 | 3/1964 | Mairs | 229/41 B |
| 3,199,762 | 8/1965 | Coons | 229/41 B |
| 3,291,364 | 12/1966 | Fischer | 206/600 |
| 3,366,308 | 1/1968 | Phillips, Jr. | 229/41 B |
| 3,708,861 | 1/1973 | Hickey . | |
| 4,091,923 | 5/1978 | Collins | 206/386 |
| 4,094,458 | 6/1978 | Nelson, Jr. . | |
| 4,343,429 | 8/1982 | Cherry . | |
| 4,372,477 | 2/1983 | Wytko . | |
| 4,373,637 | 2/1983 | Shippell | 206/600 |
| 4,383,609 | 5/1983 | Lochmiller | 206/600 |
| 4,392,606 | 7/1983 | Fremion | 206/600 |

FOREIGN PATENT DOCUMENTS

| | | | |
|---|---|---|---|
| 2490186 | 3/1982 | France | 206/600 |

*Primary Examiner*—David T. Fidei
*Attorney, Agent, or Firm*—Angelo Notaro

[57] ABSTRACT

A collapsible container comprises side panels which are interconnected at their side edges by end panels. The side and end panels form a container space which can be positioned on top of a pallet. A bottom length flap extends from a lower edge of each side panel. One of the length flaps is intended to be secured to the top surface of a pallet. The other length flap is flanked by bottom width flaps which are each connected to a lower edge of one of the end panels. Each panel and flap is interconnected along a score line. Each end panel has a central vertical score line between score lines connecting the end panel to the adjacent side panels which extends from its upper edge down through a connected bottom width flap so as to divide each width flap into halves. One half of each width flap also includes a diagonal score line which extends from the adjacent side panel down to meet with the central score line dividing the width panel in half. The side and end panels are advantageously made of triple-wall corrugated fibreboard while the bottom flaps are made of single-wall corrugated fibreboard.

16 Claims, 12 Drawing Figures

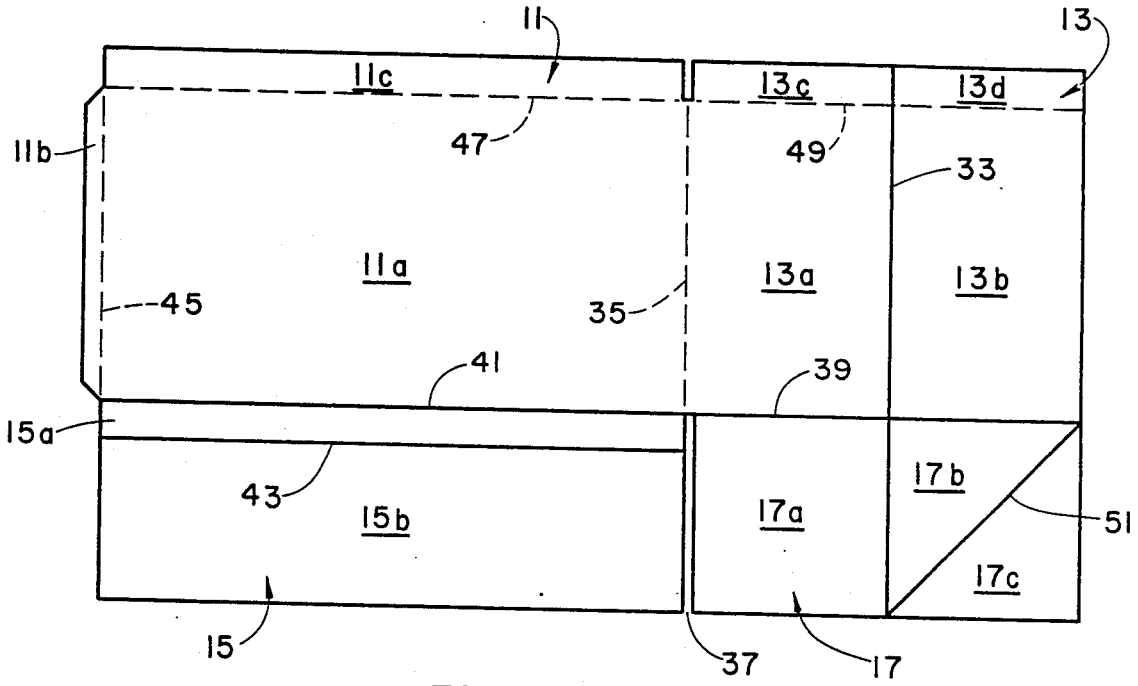
FIG. 7
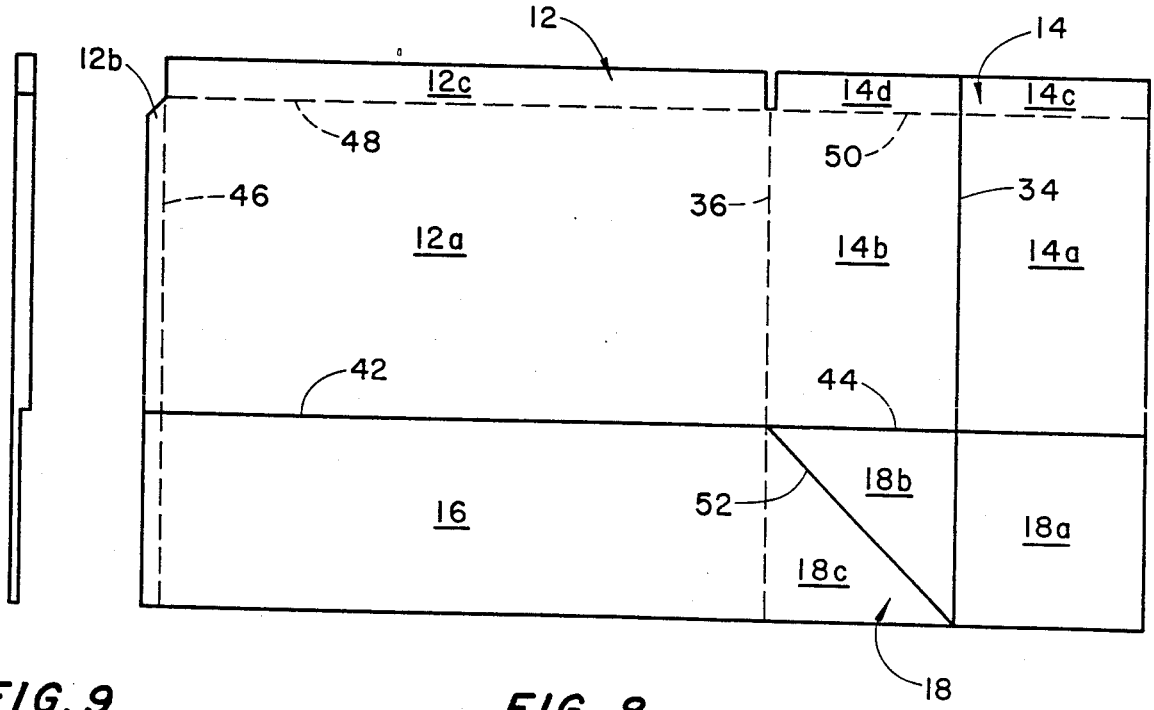
FIG. 9
FIG. 8

COLLAPSIBLE PALLET CONTAINER AND MULTI-WALL FIBREBOARD CONTAINER THEREFOR

BACKGROUND OF THE INVENTION

The present invention relates in general to shipping containers and, more particularly to a new and useful collapsible container and pallet container combination.

Cartons and boxes formed of multi-wall, corrugated fiberboard have been employed as bulk containers for bulk materials in solid, paste or liquid form and, as well, for containing a wide variety of heavy parts and materials. Such containers may, for example, be constructed from triple-wall corrugated fibreboard in accordance with the teachings of U.S. Pat. No. 2,985,553. Triple-wall corrugated fibreboard comprises three corrugated containerboard sheets and four spaced containerboard liner sheets, one of each of the corrugated sheets being interposed between a different pair of the liner sheets and adhesively secured thereto. Containerboard is the paperboard components, namely linerboard, corrugating material, filler chip, from which corrugated and solid fibreboard are manufactured.

Triple-wall corrugated fibreboard is an extremely rigid material with exceptional strength. Triple-wall corrugated fibreboard boxes exhibit great column strength and therefore, permit stacking one on top of another when containing heavy loads without excessive buckling or complete collapse of the vertical walls of the boxes.

Conventional fibreboard containers for bulk and other heavy materials are often mounted on skids or pallets to facilitate handling and a great variety of pallet containers have been used for inter-plant transportation, intra-factory use and for warehousing purposes. Such containers may be collapsible or expandable. The fibreboard container is typically strapped, nailed or stapled to the pallet. If the container is to be reusable, it is highly desirable that it be capable of being knocked down and folded flat in a manner that will reduce its bulk by at least two-thirds from its normal shipping cubage when folded. Moreover, it is desirable to be able to maintain the association of the container and pallet to facilitate shipping, storage and reassembly of the pallet container. Rigid attachment of the container to the pallet, while providing assurance of the continued association of these components, restricts the degrees of freedom through which the container can be manipulated from set-up to knocked down folded flat condition, and vice versa, as well as affecting the knocked down folded flat configuration which can be obtained possibly requiring more than the optimum amount of storage surface area that would otherwise be needed.

As used here, it will be understood that "folded flat" does not imply that the container is in a literally folded into a flat sheet form but that in such a manner as to substantially reduce its bulk from its normal shipping cubage when not folded.

U.S. Pat. No. 4,373,637 discloses a collapsible corrugated fibreboard container which has a segmented floor. Part of the segmented floor of the collapsible container is permanently fastened to the top surface of a pallet. The container can be collapsed into a folded condition with the various panels and flaps of the container all lying folded flat above the pallet. In this way, the pallet and collapsed container take up less space for storage. The folded container can be assembled into a large box configuration substantially over the entire surface of the pallet. The floor of the container comprises two separate flaps each divided into two halves. The inner halves overlie the center of the pallet and are permanently attached to the pallet while the outer halves of each floor panel fold upwardly when the container is folded and collapsed on top of the pallet. This reduces the amount of freedom a person has in manipulating a container when trying to unfold a container into its erect condition.

U.S. Pat. No. 3,708,861 discloses a pallet mounted container which has only a single floor flap fastened to the top surface of the pallet, thus permitting the entire container to be tilted out away from the pallet. The remaining floor flaps of the container are of conventional design, however, and no provision is made for collapsing the container into a small volume storage condition on top of the pallet.

Other pallet mounted containers are disclosed by U.S. Pat. Nos. 3,291,364 and 3,036,752.

Collapsible storage containers are disclosed by U.S. Pat. Nos. 4,094,458 and 2,761,609. Storage containers having unusual floor panel designs are disclosed in U.S Pat. Nos. 4,372,477 and 4,343,429.

Triple-wall corrugated fibreboard containers give rise to rather unique problems due to the thickness and rigidity of the fibreboard components. Folding techniques which are readily adaptable to standard containers may not be applicable to triple-wall corrugated fibreboard containers. Moreover, it is desirable to minimize mechanical scoring of such fibreboard due to the inherent loss of strength associated therewith and, as well, to avoid increased fabrication cost associated with unnecessary process steps.

SUMMARY OF THE INVENTION

In accordance with the invention, a collapsible pallet container and multi-wall fibreboard container therefor, includes a pallet and a blank having four serially interconnected panels comprising opposed first and second side panels and opposed first and second end panels in the assembled container. First and second bottom length flaps are hingedly connected along score lines of the first and second side panels, respectively, and first and second bottom width flaps are hingedly connected along score lines to the first and second end panels, respectively. The first bottom length flap includes a longitudinal score line parallel to the score line intermediate the first side panel and the first bottom length flap so as to divide the first bottom length flap into a moveable flap portion between the said score lines and an attachment flap portion. The attachment flap portion of the first bottom length flap is designed to be fixed to the pallet. Each of the first and second end panels and first and bottom end flaps have a central score line so that the first end panel and first bottom width flap and the second end panel and second bottom width flap are capable of folding inwardly between the first and second side panels and bottom length flaps. Each of said bottom width flaps has a diagonal score line extending from the central score line to the edge and/or score line intermediate the end panel and bottom width flap at a point substantially adjacent to the second side panel.

Thus, the fibreboard container, according to the present invention, is permanently fixed to the top surface of a pallet via a single floor flap. The container can be folded into a knocked down folded flat condition, on top of the pallet, for storage and transport. When the container is to be used, it is unfolded and set up into an assembled condition. Substantially, the entire container is pivoted up away from the pallet about a score line which connects a single fixed floor flap to the remainder of the container. The remaining floor flaps, which in the stored condition are folded between the fixed flap and side panels of the container, are then folded out on top of the fixed flap. An upper side panel of the container is then lifted up away from a lower side panel. End panels of the container, which in their stored condition were folded in bellow-like fashion, are then expanded. This frees the moveable floor flaps which can then be folded into a flattened condition. This is facilitated by diagonal score lines. Once the floor panels are flattened, the container as a whole can be pivoted up onto the pallet, again using the score line between the fixed floor flap and the remainder of the pallet as a fulcrum.

According to one advantageous feature of the invention, the side and end panels, which form the vertical walls of the assembled container, are made of triple-wall corrugated fibreboard. Such triple-wall fibreboard comprises three fluted layers which are adhesively bound between four space sheets of containerboard. The floor flaps are advantageously made of a single wall corrugated fibreboard, that is, a single fluted layer adhesively bonded between two spaced apart sheets of containerboard.

To facilitate the flat folding of the collapsed container on top of the pallet, the fixed floor flap includes a spaced portion which is connected to the remainder of the fixed floor flap at a score line which is parallel to the score line about which the remainder of the container pivots for erecting the container.

Accordingly, an object of the present invention is to provide a collapsible container for mounting on top of a pallet which comprises a pair of side panels which are connected together by a pair of spaced apart end panels. The side and end panels are serially connected together along score lines. Each of the end panels have a central transverse score line so that the panels can be collapsed in bellow-like fashion between the side panels and the side panels moved toward each other. Bottom length flaps are connected at score lines to bottom edges of the side panels and bottom width flaps are connected at score lines to bottom edges of the end panels. The central transverse score lines of each of the end panels extend through their respective width flaps. One of the bottom length panels is connected to the top of the pallet at a location near one edge of the pallet. Halves of the width panels adjacent a common side panel include a diagonal score line. The diagonal score lines are positioned on opposite sides of the remaining length flap. Each diagonal score line starts at the score line separating the length flap from the side panel, and terminates at the free edge of the width panel adjacent the respective central score line.

Another object of the present invention is to provide such a collapsible container wherein the container can be made from a one piece or two piece blank. For the one piece blank, one of the side panels is provided with a side connecting flange extending from one of its side edges. The side connecting flange can be glued, stitched, stapled or otherwise connected to an exposed side edge of one of the end panels. If a two piece blank is utilized, both side panels include an exposed edge with a connecting flap. Conversely, the end panels may be provided with the connecting flange.

A further object of the present invention is to provide a collapsible container which is particularly suited for use with a pallet and which has side and end panels which are made of triple-wall corrugated fibreboard and bottom flaps made of single-wall corrugated fibreboard.

A still further object of the present invention is to provide a collapsible container for use with a pallet which is simple in design, rugged in construction and economical to manufacture.

For a better understanding of the invention, reference is now made the accompanying drawings and descriptive matter which illustrate the embodiments of the invention.

BRIEF DESCRIPTION OF THE DRAWINGS

In the accompanying drawings, forming a part of this specification, and in which reference numerals shown in the drawings designate like or corresponding parts throughout the same.

FIG. 7. is a side elevational view showing the outside surface of a blank half for making a container of the present invention;

FIG. 8 is a view similar to FIG. 7 showing the outside surface of a remaining blank half for making a container of the present invention;

FIG. 9 is side elevational view of the blank half shown in FIG. 8;

DESCRIPTION OF THE PREFERRED EMBODIMENTS

Figure 1:
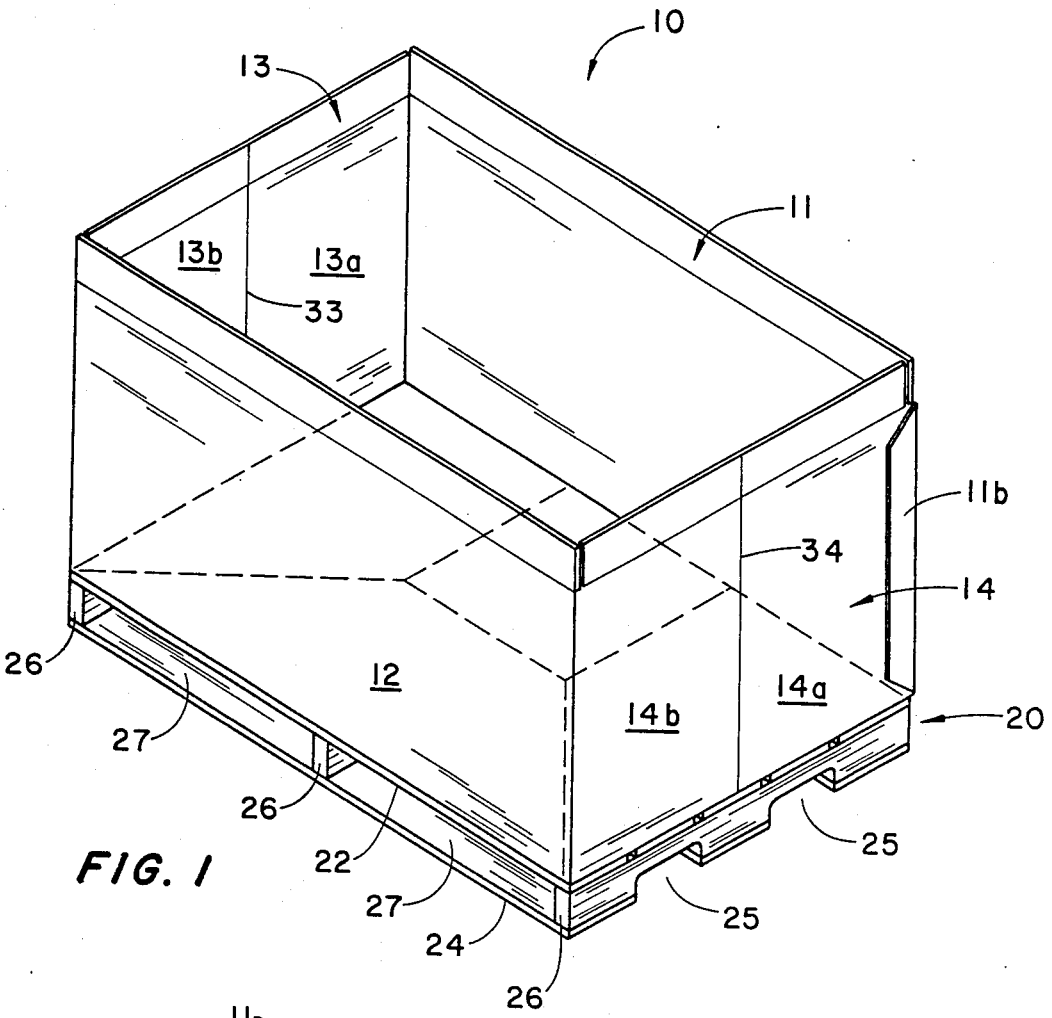
FIG. 1 is a top side perspective view showing the erected container of the present invention on a pallet.

In FIG. 1, a collapsible container, generally designated 10, is shown mounted on the top surface of a pallet 20.

Pallet 20, as shown in FIG. 1, is a conventional four-way entry pallet and comprises a top deck 22 of parallel boards fastened, for example by nails or other suitable deck fasteners, to three or more notched stringers 26, and a bottom deck of boards 24 secured to projecting portions of the stringers 26. The stringers 26 include spaced apart indentations 25 which permit the entry of the forks of a fork lift or a fork truck. In like fashion, spaces 27 between supports 26 can be used to admit the forks of a hand pallet truck.

Although the four-way pallet 20 is advantageously made of wood or plastic, other known pallet materials and designs can be used in conjunction with the present invention. The only requirement is that the pallet include an upper surface to which a bottom flap of the container can be secured.

Figure 2:
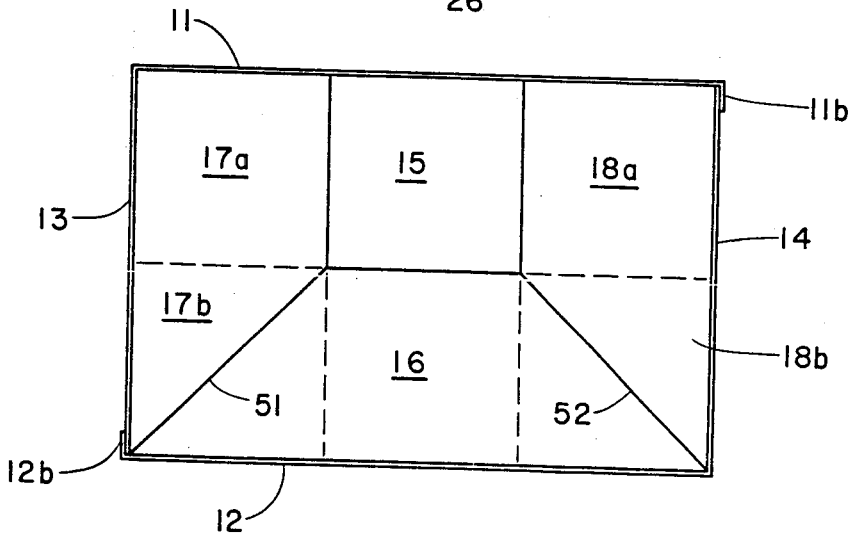
FIG. 2 is a top plan view of the container shown in FIG. 1.

As shown in FIGS. 1 and 2, the assembled container includes four serially interconnected panels comprising opposed side panels 11, 12 and opposed end panels 13, 14. The panels, 11 through 14, are hingedly connected to adjacent panels at their respective side edges along score lines. Depending on the direction in which the fibreboard is to be folded, the score lines are formed on the fibreboard surface either on the inside or the outside of the container.

In one embodiment of the invention, two blanks or blank halves are used to form the container. The blanks, as shown in FIGS. 7 and 8, each include a connecting flange 11*b*, 12*b* attached to a side edge of the respective side panels 11 and 12. The blanks are interconnected by attaching the connecting flanges 11*b*, 12*b* to an exposed side edge of the respective end panels 13, 14. This attachment can be made by a stitch line of staples, thread, adhesive, or by other conventional means.

As shown in FIGS. 1 and 7, end panel 13 is divided by an elongated vertical central score line 33 into halves 13A and 13B. Similarly, as shown in FIGS. 1 and 8, end panel 14 is divided by a central score line 34 into right and left halves 14A, 14B. Side panels 11 and 12 are hingedly connected to end panels 13 and 14, respectively, along score lines 35 and 36.

Figure 3:
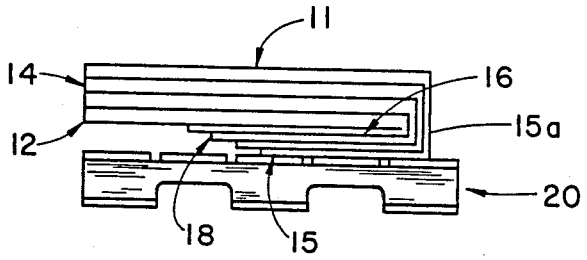
FIG. 3 is a side elevational view showing the collapsed container secured on top of a pallet.

The side panels 11, 12 are connected to respective bottom length flaps 15, 16 along score lines 41, 42, respectively. The bottom length flap 15 also includes an additional score line 43 which is spaced from the score line 41 by a distance which substantially equals the combined thickness of the first and second side panels and twice that of the first and second end panels. The bottom length flap 15 is thus divided by score line 43 into a fixed attachment flap portion 15*b*, which is designed to be connected to the top surface of a pallet, and a moveable flap portion 15*a*. FIG. 3 shows the position of moveable portion 15*a* with the container in its knock down folded flat or collapsed condition. A score line (not shown) in longitudinal alignment with score line 43 may be extended through width flap 17 for ease of manufacture of the blank half but, such a score line, has no structural function in respect of the container.

Figure 5:
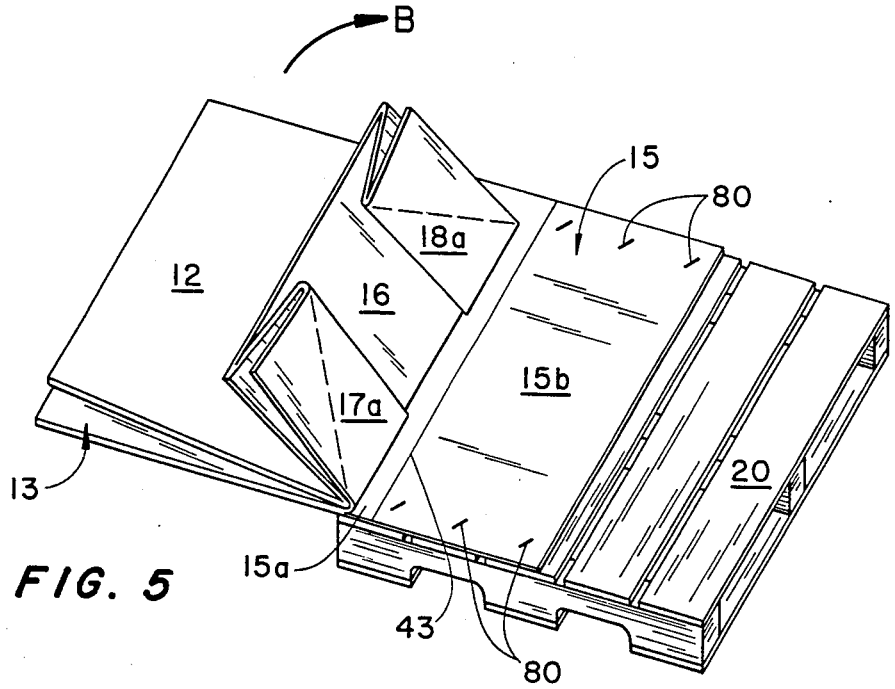
FIG. 5 is a top side perspective view showing the subsequent manipulating step for unfolding the container.
Figure 6:
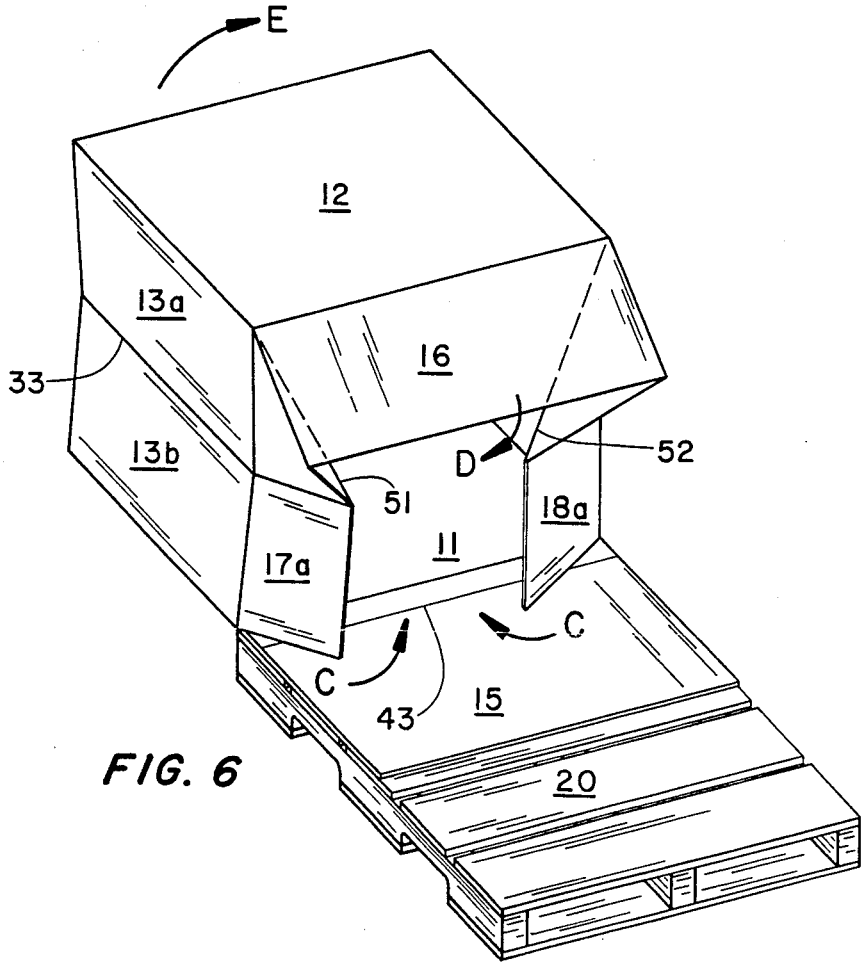
FIG. 6 is a top side perspective view showing a still subsequent manipulative step in assembling the container.

Fixed attachment flap portion 15*b* is also advantageously connected to the top surface of the pallet so as to keep score line 43, as is best shown in FIGS. 5 and 6, spaced from an outer edge of the pallet by an amount substantially equal to the width of one moveable flap portion 15*a*, as defined by the distance between foldlines 41 and 43. In this way, with the container in the assembled position, shown in FIG. 1, the side and end walls of the container substantially overlie the periphery of the upper surface of the pallet.

FIGS. 7 and 8 also illustrate bottom width flaps 17, 18 which are connected, along score lines 39, 44, to respective end panels 13, 14. As shown in FIG. 8, the score line 36, between side panel 12 and end panel 14, extends down between the bottom length flap 16 and the bottom width flap 18. A slot 37, as shown in FIG. 7, is provided between bottom length flap 15 and bottom width flap 17. Bottom length flap 15 is thus cantilevered from side panel 11 so that the remainder of the container can pivot relative to the bottom length flap 15 via score lines 41, 43 which act as fulcrums as is more particulary described hereafter.

Flap halves 17*a* and 18*a* of the bottom width flaps 17, 18 include no further score lines. The remaining flap halves 17*b*, 17*c* and 18*b*, 18*c* of each bottom flap 17 and 18, respectively, include diagonal score lines 51, 52 which divide each of these bottom flap halves into triangular portions into 17*b*, 17*c* and 18*b*, 18*c*. Each diagonal line extends from the intersection of the score line 39, 44 and score line 36 or side edge designed to be placed adjacent to the side panel 12 (when the two blanks are connected) and terminates at the intersection of the free edge and central score line 33 or 34.

FIGS. 7 and 8 illustrate the outer surface of the blank halves. Thus, each of the score lines shown as a solid line is a score line on the outer surface of the blank. Each of the score lines shown as dotted lines are reverse score lines, i.e., formed on the opposite or inside surface of the blank, as illustrated in FIGS. 7 and 8, with respect to the space formed by the assembled container. Reverse score lines 45 and 46 thus separate the connecting flanges 11*b*, 12*b* from their respective side panels. Some of the score lines, such as score lines 39, 41, 42 and 44, which connect the bottom flaps to the side and end panels, are formed on both sides of the blank to allow folding in both directions, and are therefore illustrated in solid lines.

FIGS. 7 and 8 also show top length and width flaps 11*c*, 12*c*, 13*c*, 13*d*, 14*c* and 14*d*. These top flaps can be folded down along score lines 47, 48, 49 and 50. Their corner areas can be connected together or their flaps can simply be folded down into the space of the container in order to stiffen the upper edges of the side and end panels. In forming score lines in relatively thick multi-wall board, for example, triple-wall corrugated fibreboard and scoreline 47, 48, 49 and 50, it is often advisable to form a first score on one face and two parallel scores on either side of the first score on the opposite face of the blank.

Figure 10:
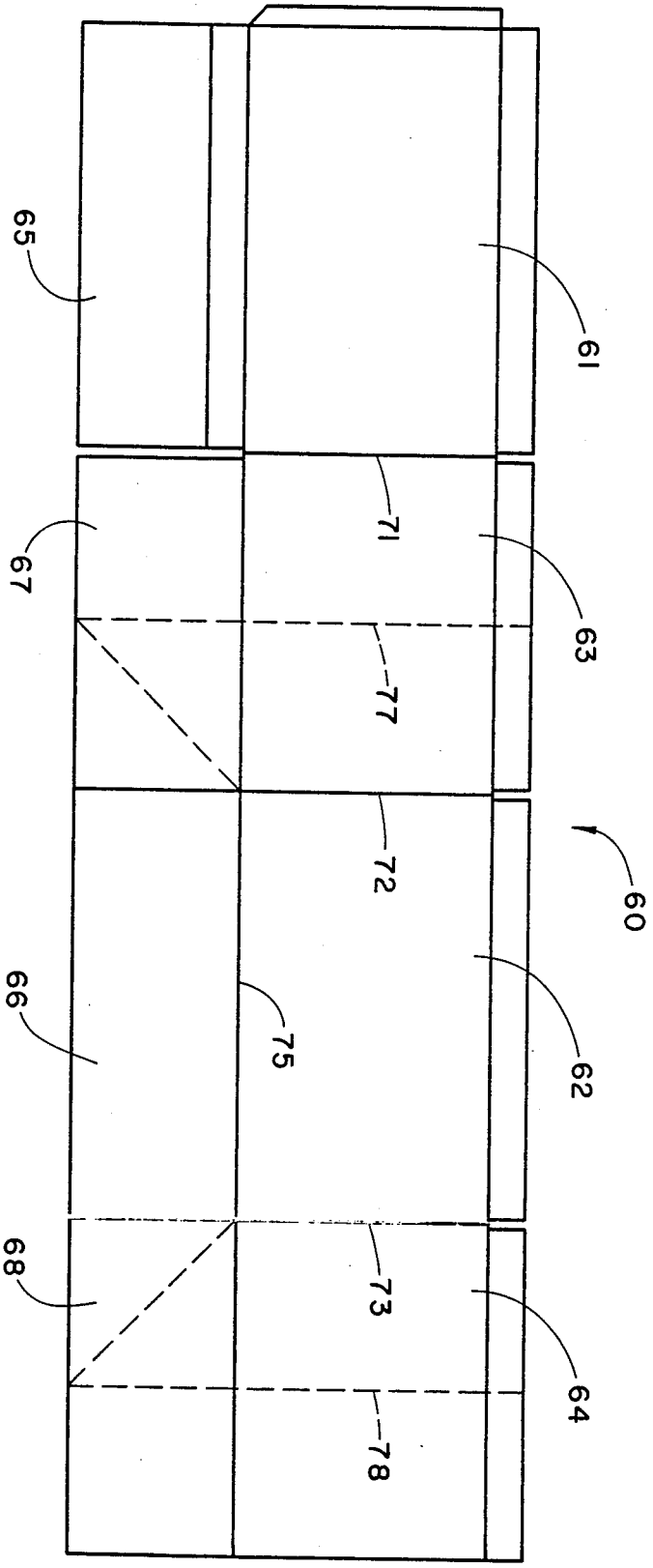
FIG. 10 is an inside elevational view of a one piece blank for the making of the present invention.

FIG. 10 illustrates an alternate embodiment of the invention wherein a single piece blank 60 is used to make the container shown in FIG. 1. Blank 60 is divided into side panels 61, 62 and end panels 63, 64 by transverse score lines 71, 72, and 73. Side panels 61 and 62 are interconnected by end panels 63 and 64 when the blank is assembled into a container. Blank length flaps 65, 66 are connected along longitudinal score line 75 to side panels 61, 62. Width flaps 67, 68 are connected along longitudinal score line 75 to respective end panels 63, 64. FIG. 10 illustrates the inside surface of the blank, i.e., the surface which ultimately faces the inside space of the assembled container. Reverse score lines are shown in dotted lines while the facing score lines are shown in solid lines.

Figure 12:
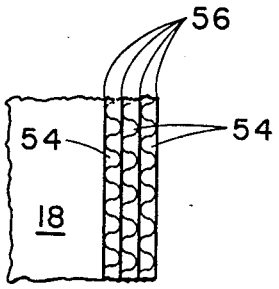
FIG. 12 is a partial section taken along line 12—12 of FIG. 11.
Figure 11:
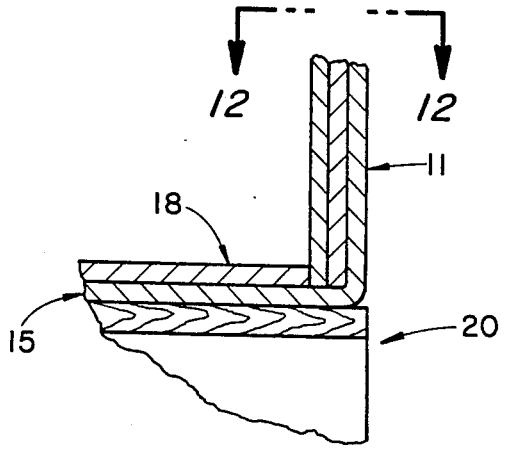
FIG. 11 is an enlarged sectional view showing a corner area of the assembled container, revealing its layered structure.

FIGS. 9 and 11 also show the side structures of the panels and flaps. Each of the the panels is thicker than its respective flap. As particularly shown in FIGS. 11 and 12, each of the side and end panels is preferably made of triple-wall corrugated fibreboard. The fibreboard comprises three corrugated containerboard sheets 54 and four spaced containerboard liner sheets 56, one of each of said corrugated sheets being interposed between a different pair of said liner sheets. Each bottom flap, such as flap 15 shown in FIG. 11, however, is preferably composed of a single-wall corrugated fibreboard comprising a single corrugated sheet 54 which is adhesively connected to a pair of spaced liner sheets 56. For additional strength, the flaps can be either double-wall or triple-wall corrugated fibreboard sheet.

In the assembled condition, the corrugations of the panels extend perpendicularly relative to the horizontal.

Figure 4:
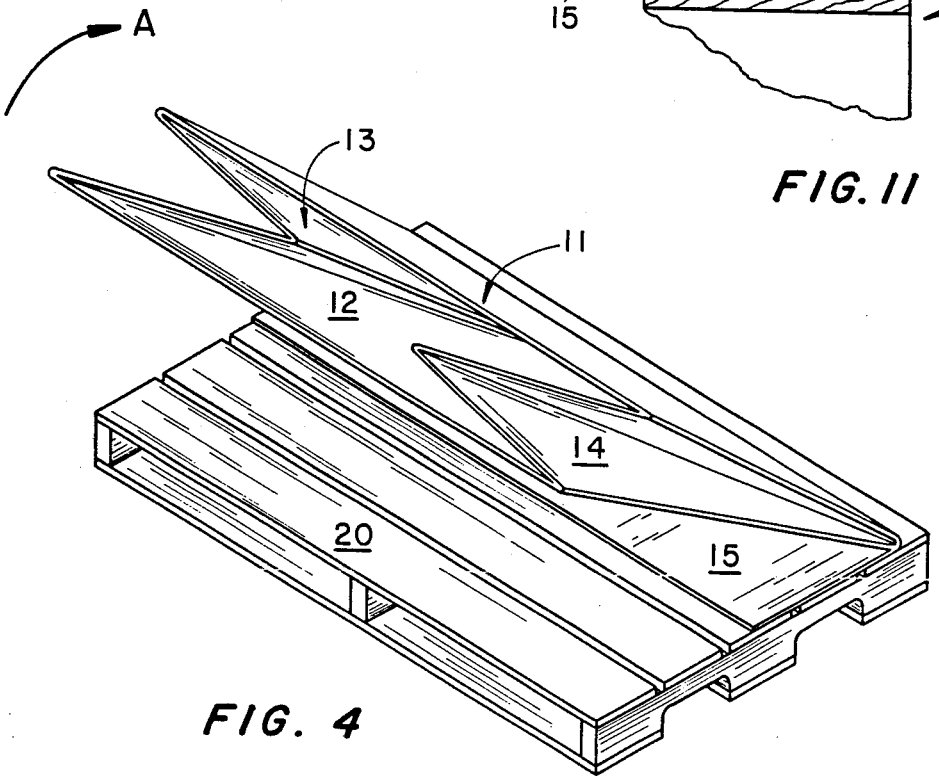
FIG. 4 is a top side perspective view showing a first manipulated step for unfolding the collapsed container.

In order to assemble the container of the invention, from the position shown in FIG. 3, all but the bottom fixed attachment flap 15*b* is pivoted about score line 43 upwardly, in the direction of arrow A shown in FIG. 4, to expose the remaining bottom flaps as shown in FIG. 5. This movement causes the bottom length flap portion 15*a* of bottom flap 15 to lay onto the top surface of pallet 20. The remaining bottom flaps 16, 17 and 18, which were initially folded between the side panel 12 and the fixed attachment flap 15*b*, are then folded over in the direction of arrow B.

Next, as shown in FIG. 6, side panel 12 is then lifted up away from side panel 11 to deploy the end panels 13 and 14, thereby permitting the end panel halves 13*a*, 13*b* and 14*a*, 14*b* to unfold along their respective central scores 33 and 34. It is noted that during this phase of unfolding the container, the bottom width flaps 17 and 18 are substantially parallel to each other and extend outwardly from the end panels 13 and 14.

The lower halves 17*a* and 18*a* of the width flaps are then folded in, in the direction of arrow C shown in FIG. 6. The bottom length flap 16, extending from the side panel 12, is then folded down along the diagonal score lines 51 and 52 and along the edge score lines which connect flap 16 to the flaps 17 and 18. Flap 16 is thus folded down in the direction of arrow D. This forms a flattened bottom portion for the container made up of flaps 16, 17 and 18. The container is then pivoted up in the direction of arrow E, onto the flap 15 and the remaining exposed top of the pallet 20. This brings the container back to the position shown in FIG. 1. To collapse the container, the foregoing sequence of steps is simply reversed.

The bottom fixed attachment flap is fastened to pallet 20 by stapling 80, as shown in FIG. 5, or by other suitable fasteners or conventional attachment means.

Whereas specific embodiments of the invention have been shown and described in detail, it is understood that the invention can be embodied otherwise without departing from the principals thereof.

The invention claimed is:

1. A container for mounting on the top of a pallet, comprising:

a first side panel having top and bottom edges and first and second side edges;

a first end panel having top and bottom edges, a first side edge connected along a score line to said second side edge of said first side panel, and a second side edge;

a second side panel having top and bottom edges, a first side edge connected along a score line to said second side edge of said first end panel, and a second side edge;

a second end panel having top and bottom edges, a first side edge connected along a score line to said second side edge of said second side panel, and a second side edge connected along a score line to said first side edge of said first side panel;

a first bottom length flap connected along a score line to said bottom edge of said first side panel and being adapted to be connected to the top of a pallet, said first bottom length flap having first and second side edges;

a first bottom width flap connected along a score line to said bottom edge of said first end panel, said first bottom width flap having a first side edge which is free from but adjacent to said second side edge of said first bottom length flap to define a slot therebetween, and a second side edge;

a second bottom length flap connnected along a score line to said bottom edge of said second side panel, said second bottom length flap having a first side edge connected along a score line to said second side edge of said first bottom width panel, and a second side edge; and a second bottom width flap connected along a score line to said bottom edge of said second end panel, said second bottom width flap having a first side edge connected along a score line to said second side edge of said second bottom length flap and a second side edge free from but adjacent to said first side edge of said first bottom length flap;

means for connecting said first and second side panels and said first and second end panels defining a container space therebetween;

each of the first and second end panels with their connected respective first and second bottom width flaps, having a central score line extending from the top edges of said first and second end panels through said first and second bottom width flaps, whereby said end panels and bottom width flaps are foldable inwardly of the container space along each central score line;

one-half of each bottom width flap between said central score line and said second bottom length flap having a diagonal score line extending from said second bottom length flap to an end of said central score line on said bottom width flap, whereby said half is foldable inwardly of the container space along the diagonal foldline.

2. A container according to claim 1 wherein said score lines between said side and end panels and between said bottom length and bottom width flaps are on an inside surface of said container adjacent the container space, said central and diagonal score line being on an outside surface of said container outside of said container space.

3. A container according to claim 1 wherein said bottom length flap has a second score line extending parallel to said score line between said first side panel and said first bottom length flap, the distance between said second score line and said score line between said first side panel and said first bottom length flap being about equal to a total thickness of said first and second side panels plus twice the thickness of said first and second end panels.

4. A container according to claim 1 wherein said bottom width flaps and said bottom length flaps are all made of single-wall fibreboard and, said side panels and end panels all being made of triple-wall fibreboard.

5. A container according to claim 4 wherein said score lines between said side and end panels and between said bottom length and bottom width flaps are on an inside surface of said container adjacent the container space, said central and diagonal score line being on an outside surface of said container outside of said container space.

6. A container according to claim 5 wherein said first bottom length flap has a second score line extending parallel to said score line between said first side panel and said first bottom length flap, the distance between said second score line and said score line between said first side panel and said first bottom length flap being about equal to a total thickness of said first and second side panels plus twice the thickness of said first and second end panels.

7. A container according to claim 1 further comprising a top length flap connected to the top edge of each side panel along a score line and a top width flap connected to each top edge of each end panel along a score line.

8. A container according to claim 1 wherein said panels and flaps are all formed on two blank halves, each blank half carrying one side panel one end panel, one bottom length flap and one bottom width flap, each of blank halves further comprising one side connecting flange connected at an exposed side edge of one of said side and end panels, said blank half carrying the first bottom length flap having a slot between said first bottom length flap and said first bottom width flap, said diagonal score line of said first bottom width flap being spaced away from said first bottom length flap, said blank half carrying said second bottom length flap having said diagonal foldline of said second width flap adjacent said second bottom length flap.

9. A container according to claim 1 wherein a single blank comprises all of the panels and flaps, one exposed side edge of one of said panels further comprising a side connecting flange connected thereto along a score line, said blank including a slot between said first bottom length flap and said first bottom width flap.

10. A blank for making a collapsible container to be mounted on a pallet, comprising;

a first side panel and a first end panel hingedly connected to the first side panel along a score line;

the first side and end panels together having a single longitudinal lower edge;

first length and width flaps connected along a score line to the lower edge respectively adjacent the first side and end panels, the first length flap including a further score line spaced from said edge defining a portion of said first length flap therebetween having a selected width, the first length flap being spaced from the first width flap to define a slot therebetween;

the first end panel and first width flap having a central score line extending perpendicularly to the lower edge, the central score line dividing the first end panel and width flap into equal halves, the half of the width flap remote from the first length flap having a diagonal score line extending from the first end panel to the central score line at an end of the central score line in the first width flap;

a second side panel and a second end panel hingedly connected to the second side panel along a score line and together having a single longitudinal bottom edge;

second length and width flaps connected to the bottom edge of the second side and end panels and extending respectively below the second side and end panels, the second length and width flaps being hingedly connected together along a score line;

the second end panel and second width flap having a central score line therein extending perpendicularly to the bottom edge of the second side and end panels and dividing the second end panel and the second width flap into equal halves, the half of the second width flap adjacent and connected to the second length flap having a diagonal score line extending from the second side panel to an end of the second central score line in the second width flap; and a side connecting flange connected to an exposed side edge of at least one of said panels.

11. A blank according to claim 10 wherein blank comprises two halves, each half having an exposed side edge and each half including one side connecting flange.

12. A blank according to claim 10 wherein the blank is made of one piece and includes a single side connecting flange.

13. A blank according to claim 12 wherein the panels are all made of triple-wall corrugated fibreboard, and each of said flaps comprise single wall corrugated fibreboard.

14. A blank according to claim 10 wherein the blank has an outer surface and an opposite inner surface, said inner surface being adapted to face a space to be formed within a container comprising the blank, the score lines between the panels all being formed on the inner surface of the blank, the score lines between the end panels and the width flaps all being formed on both the inner and outer surfaces, said central score lines and said diagonal score lines all being formed by said outer surface.

15. A blank according to claim 14 wherein the further score line comprises score lines formed on both the inner and outer surfaces.

16. A blank according to claim 15 wherein the blank comprises two pieces, one piece including the first side and end panels and another piece including the second side and end panels, each of said first and second side panels having a side edge remote from its respective end panel, each side panel including a side connecting flange at its exposed side edge.

* * * * *